US011415000B2

(12) United States Patent
Lee et al.

(10) Patent No.: US 11,415,000 B2
(45) Date of Patent: Aug. 16, 2022

(54) TURBINE AIRFOIL WITH TRAILING EDGE FEATURES AND CASTING CORE

(71) Applicant: Siemens Energy Global GmbH & Co. KG, Munich (DE)

(72) Inventors: Ching-Pang Lee, Cincinnati, OH (US); Jae Y. Um, Winter Garden, FL (US); Sin Chien Siw, Oviedo, FL (US); Anthony Waywood, Cincinnati, OH (US); Harry Holloman, Maineville, OH (US); Steven Koester, Toledo, OH (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 179 days.

(21) Appl. No.: 16/623,824

(22) PCT Filed: Jun. 4, 2018

(86) PCT No.: PCT/US2018/035770
§ 371 (c)(1),
(2) Date: Dec. 18, 2019

(87) PCT Pub. No.: WO2019/005425
PCT Pub. Date: Jan. 3, 2019

(65) Prior Publication Data

US 2021/0140321 A1 May 13, 2021

Related U.S. Application Data

(60) Provisional application No. 62/527,229, filed on Jun. 30, 2017.

(51) Int. Cl.
*F01D 5/18* (2006.01)
*B22C 9/10* (2006.01)

(52) U.S. Cl.
CPC ..... *F01D 5/187* (2013.01); *B22C 9/10* (2013.01); *F05D 2230/21* (2013.01); *F05D 2240/304* (2013.01); *F05D 2260/221* (2013.01)

(58) Field of Classification Search
CPC . F01D 5/187; B22C 9/10; F05D 2260/22141; F05D 2240/304
See application file for complete search history.

(56) References Cited

U.S. PATENT DOCUMENTS 5,752,801 A * 5/1998 Kennedy ..... F01D 5/187 415/115
6,602,047 B1 8/2003 Barreto et al.
(Continued)

FOREIGN PATENT DOCUMENTS

CN 102089498 A 6/2011
CN 104285037 A 1/2015
(Continued)

OTHER PUBLICATIONS

PCT International Search Report and Written Opinion dated Aug. 24, 2018 corresponding to PCT Application No. PCT/US2018/035770 filed Jun. 4, 2018.

*Primary Examiner* — Eldon T Brockman

(57) ABSTRACT

A turbine airfoil includes a trailing edge coolant cavity between a pressure sidewall and a suction sidewall. The trailing edge coolant cavity is positioned adjacent to and extending out to a trailing edge of the turbine airfoil. The interior includes an internal arrangement comprising an array of discrete fins formed aft of the trailing edge coolant cavity along the trailing edge.

11 Claims, 4 Drawing Sheets

(56) References Cited

U.S. PATENT DOCUMENTS

| | | | | |
|---|---|---|---|---|
| 7,785,070 | B2 * | 8/2010 | Liang | F01D 5/187 416/97 R |
| 8,172,505 | B2 * | 5/2012 | Fujimoto | F01D 5/187 415/115 |
| 2001/0012484 | A1 | 8/2001 | Beeck et al. | |
| 2009/0068022 | A1 * | 3/2009 | Liang | F01D 5/187 416/97 R |
| 2009/0126335 | A1 * | 5/2009 | Fujimoto | F01D 5/187 60/39.83 |
| 2011/0176930 | A1 | 7/2011 | Ahmad et al. | |
| 2013/0156599 | A1 | 6/2013 | Ahmad | |
| 2013/0302179 | A1 | 11/2013 | Bergholz, Jr. et al. | |
| 2014/0169962 | A1 | 6/2014 | Lee | |
| 2014/0193273 | A1 | 7/2014 | Bommanakatte et al. | |
| 2014/0321980 | A1 | 10/2014 | Lee et al. | |
| 2015/0037165 | A1 | 2/2015 | Jones et al. | |
| 2015/0159489 | A1 | 6/2015 | Lee et al. | |
| 2016/0208620 | A1 | 7/2016 | Thistle et al. | |
| 2018/0058225 | A1 | 3/2018 | Marsh et al. | |
| 2018/0266254 | A1 | 9/2018 | Lee | |
| 2020/0291787 | A1 | 9/2020 | Lee | |

FOREIGN PATENT DOCUMENTS

| | | | |
|---|---|---|---|
| CN | 104854311 | A | 8/2015 |
| DE | 102005012803 | A1 | 9/2006 |
| EP | 2426317 | A1 | 3/2012 |
| JP | H10311203 | A | 11/1998 |
| JP | 2003278503 | A | 10/2003 |
| JP | 2013536913 | A | 9/2013 |
| JP | 2014134201 | A | 7/2014 |
| JP | 2015031284 | A | 2/2015 |
| JP | 2019512641 | A | 5/2019 |
| WO | 2015073092 | A2 | 5/2015 |
| WO | 2016160029 | A1 | 10/2016 |
| WO | 2017074403 | A1 | 5/2017 |
| WO | 2017164935 | A1 | 9/2017 |

* cited by examiner

VIEW II-II

View V-V

TURBINE AIRFOIL WITH TRAILING EDGE FEATURES AND CASTING CORE

BACKGROUND

1. Field

The present invention is directed generally to turbine airfoils, and more particularly to an improved trailing edge cooling feature for a turbine airfoil.

2. Description of the Related Art

In gas turbine engines, compressed air discharged from a compressor section and fuel introduced from a source of fuel are mixed together and burned in a combustion section, creating combustion products defining a high temperature and high pressure working gas. The working gas is directed through a hot gas path in a turbine section of the engine, where the working gas expands to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as airfoils, e.g., stationary vanes and rotating blades within the turbine section, must be cooled with cooling fluid, such as air discharged from a compressor in the compressor section, to prevent overheating of the components. In order to push gas turbine efficiencies even higher, there is a continuing drive to reduce coolant consumption in the turbine.

Effective cooling of turbine airfoils requires delivering the relatively cool air to critical regions such as along the trailing edge of a turbine blade or a stationary vane. The associated cooling apertures may, for example, extend between an upstream, relatively high pressure cavity within the airfoil and one of the exterior surfaces of the turbine blade. Blade cavities typically extend in a radial direction with respect to the rotor and stator of the machine. Achieving a high cooling efficiency based on the rate of heat transfer is a significant design consideration in order to minimize the volume of coolant air diverted from the compressor for cooling.

The trailing edge of a turbine airfoil is made relatively thin for aerodynamic efficiency. The relatively narrow trailing edge portion of a gas turbine airfoil may include, for example, up to about one third of the total airfoil external surface area. Turbine airfoils are often manufactured by a casting process involving a casting core, typically made of a ceramic material. The core material represents the hollow flow passages inside turbine airfoil. It is beneficial for the casting core to have sufficient structural strength to survive through the handling during the casting process. It is desirable to have an improvement to achieve not only a strong casting core but also a limitation in the coolant flow.

SUMMARY

In one aspect of the present invention, a turbine airfoil is provided. The turbine airfoil comprises an outer wall delimiting an airfoil interior, the outer wall extending span-wise along a radial direction of a turbine engine and being formed of a pressure sidewall and a suction sidewall joined at a leading edge and at a trailing edge; a trailing edge coolant cavity located in the airfoil interior between the pressure sidewall and the suction sidewall, the trailing edge coolant cavity being positioned adjacent to and extending out to the trailing edge and in fluid communication with a plurality of coolant exit slots positioned along the trailing edge; and an internal arrangement comprising an array of discrete fins located aft of the trailing edge coolant cavity and along the trailing edge, the array of discrete fins configured to extend out into the interior of the airfoil without reaching the opposite interior sidewall, the discrete fins extending out into the interior of the turbine airfoil alternating from the pressure sidewall and the suction sidewall, the discrete fins form a zigzagging cooling flow passage axially along a chord-wise direction for a cooling fluid between the pressure sidewall and the suction sidewall.

According to a second aspect of the present invention, a casting core for forming a turbine airfoil, comprises: a casting core element forming a trailing edge coolant cavity of the turbine airfoil, the core element comprising a core pressure side and a core suction side extending in a span-wise direction, and further extending chord-wise from a core leading edge toward a core trailing edge; and a plurality of discrete non-perforated indentations are provided on the surface of the core pressure side and the surface of the core suction side along the core trailing edge, the discrete non-perforated indentations forming discrete fins along the interior of the turbine airfoil trailing edge portion aft of the trailing edge coolant cavity towards the trailing edge of the turbine airfoil, with the discrete non-perforated indentations being interspaced radially by interstitial core elements that form axial coolant passages in the turbine airfoil and interspaced axially by interstitial core elements that form radial coolant passages in the turbine airfoil.

These and other features, aspects and advantages of the present invention will become better understood with reference to the following drawings, description and claims.

BRIEF DESCRIPTION OF THE DRAWINGS

The invention is shown in more detail by help of figures. The figures show preferred configurations and do not limit the scope of the invention.

DETAILED DESCRIPTION

Figure 1:
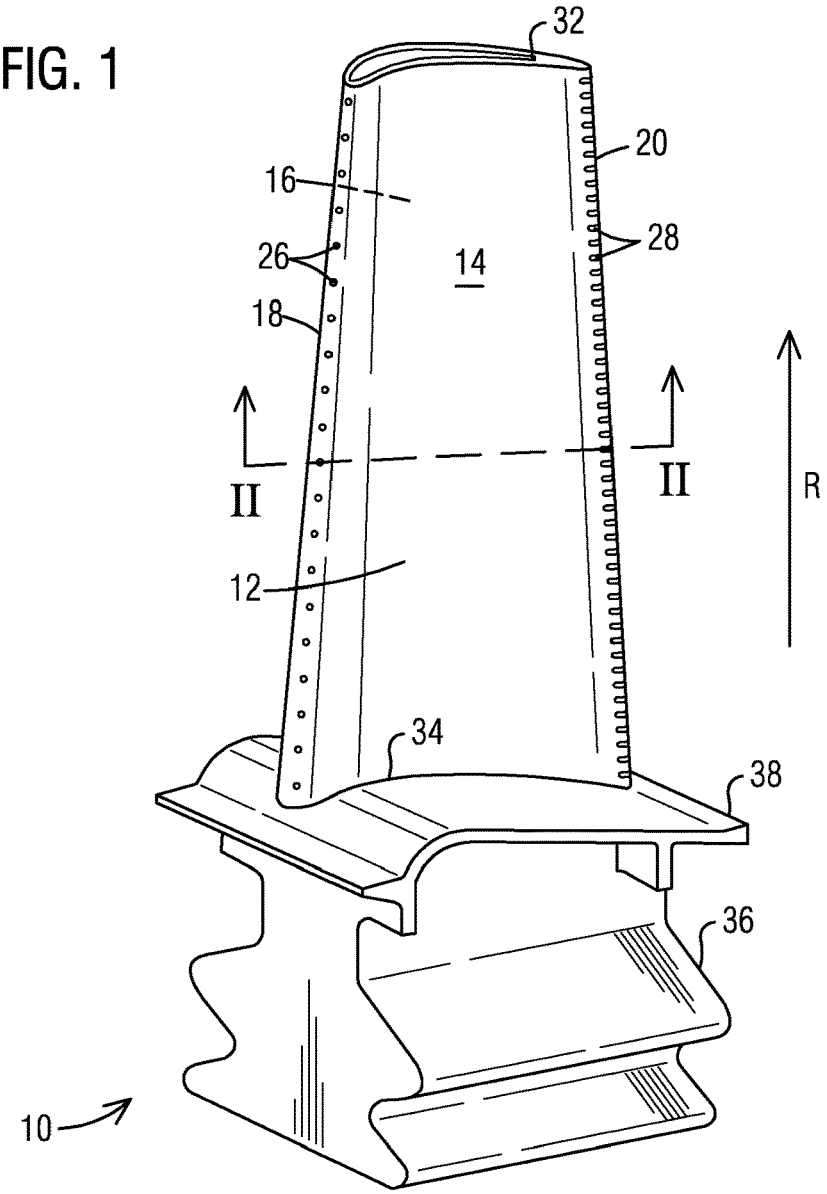
FIG. 1 is a perspective view of a turbine airfoil featuring embodiments of the present invention.

In the following detailed description of the preferred embodiments, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

In the drawings, the direction X denotes an axial direction parallel to an axis of the turbine engine, while the directions R and C respectively denote a radial direction and a circumferential (or tangential) direction with respect to said axis of the turbine engine.

Broadly, an embodiment of the present invention provides a turbine airfoil that includes a trailing edge coolant cavity located in an airfoil interior between a pressure sidewall and a suction sidewall. The trailing edge coolant cavity is positioned adjacent to and extending out to a trailing edge of the turbine airfoil. The interior further includes an internal arrangement comprising an array of discrete fins formed between the trailing edge coolant cavity and the trailing edge. The discrete fins form a zigzagging cooling flow passage axially along a chord-wise direction for a cooling fluid between the pressure sidewall and the suction sidewall.

Referring now to FIG. 1, a turbine airfoil 10 is illustrated according to one embodiment. As illustrated, the turbine airfoil 10 is a turbine blade for a gas turbine engine. It should however be noted that aspects of the invention could additionally be incorporated into stationary vanes in a gas turbine engine. The airfoil 10 may include an outer wall 12 adapted for use, for example, in a high pressure stage of an axial flow gas turbine engine. The outer wall 12 delimits an airfoil interior 11. The outer wall 12 extends span-wise along a radial direction R of the turbine engine and includes a generally concave shaped pressure sidewall 14 and a generally convex shaped suction sidewall 16. The pressure sidewall 14 and the suction sidewall 16 are joined at a leading edge 18 and at a trailing edge 20. The outer wall 12 may be coupled to a root 36 at a platform 38. The root 36 may couple the turbine airfoil 10 to a disc (not shown) of the turbine engine. The outer wall 12 is delimited in the radial direction by a radially outer airfoil end face (airfoil tip cap) 32 and a radially inner airfoil end face 34 coupled to the platform 38. In other embodiments, the turbine airfoil 10 may be a stationary turbine vane with a radially inner end face coupled to the inner diameter of the turbine gas path section of the turbine engine and a radially outer end face coupled to the outer diameter of the turbine gas path section of the turbine engine.

Figure 2:
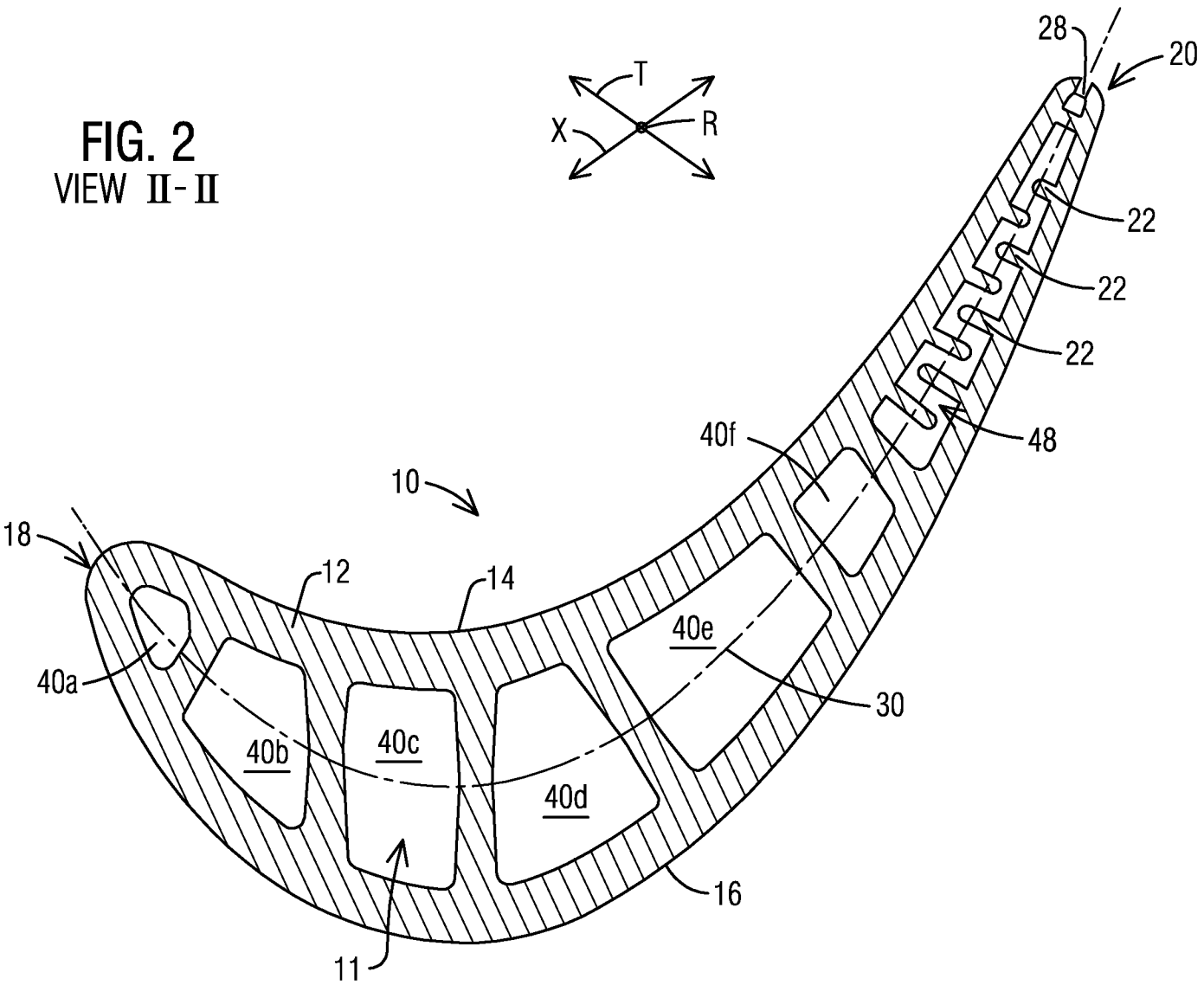
FIG. 2 is a mid-span cross-sectional view illustrating features along the trailing edge of the turbine airfoil, along section II-II of FIG. 1 according to an exemplary embodiment of the invention.

Referring to FIG. 2, a chordal axis 30 may be defined extending centrally between the pressure sidewall 14 and the suction sidewall 16. In this description, the relative term "forward" refers to a direction along the chordal axis 30 toward the leading edge 18, while the relative term "aft" refers to a direction along the chordal axis 30 toward the trailing edge 20. As shown, internal passages and cooling circuits are formed by radial coolant cavities 40*a-f* between the pressure sidewall 14 and the suction sidewall 16 along a radial extent. In the present example, coolant Cf may enter one or more of the radial cavities 40*a-f* via openings provided in the root 36 of the blade 10, from which the coolant Cf may traverse into adjacent radial coolant cavities, for example, via one or more serpentine cooling circuits. Examples of such cooling schemes are known in the art and will not be further discussed herein. Having traversed the radial coolant cavities, the coolant Cf may be discharged from the airfoil 10 into the hot gas path, for example via exhaust orifices 26, 28 located along the leading edge 18 and the trailing edge 20 respectively as shown in FIG. 1. Although not shown in the drawings, exhaust orifices may be provided at multiple locations, including anywhere on the pressure sidewall 14, the suction sidewall 16, and the airfoil tip 32.

The aft-most radial coolant cavity 40*f*, which is the closest coolant cavity to the trailing edge 20, is referred to herein as the trailing edge coolant cavity 40*f*. Upon reaching the trailing edge coolant cavity 40*f*, the coolant Cf may exit the trailing edge coolant cavity 40*f* and traverse axially through an internal arrangement 48 of trailing edge cooling features, located along the trailing edge 20, before leaving the airfoil 10 via coolant exit slots 28 arranged along the trailing edge 20. Conventional trailing edge cooling features included a series of impingement plates, arranged next to each other along the chordal axis. However, this arrangement provides that the coolant Cf travels only a short distance before exiting the airfoil at the trailing edge. It may be desirable to have a longer coolant flow path along the trailing edge portion to have more surface area for transfer of heat, to improve cooling efficiency and reduce coolant flow requirement.

Figure 6:
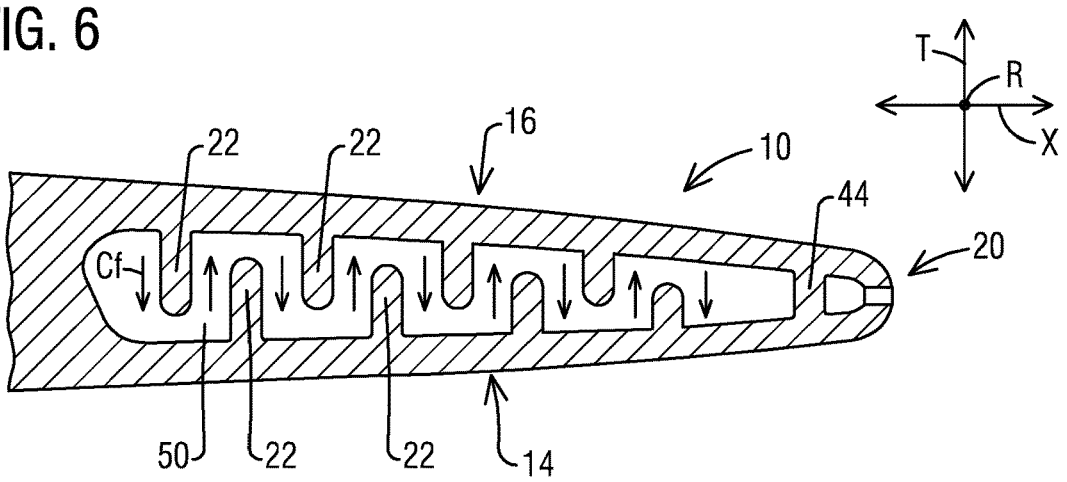
FIG. 6 is an enlarged mid-span cross-sectional view showing the trailing edge portion of the turbine airfoil.
Figure 4:
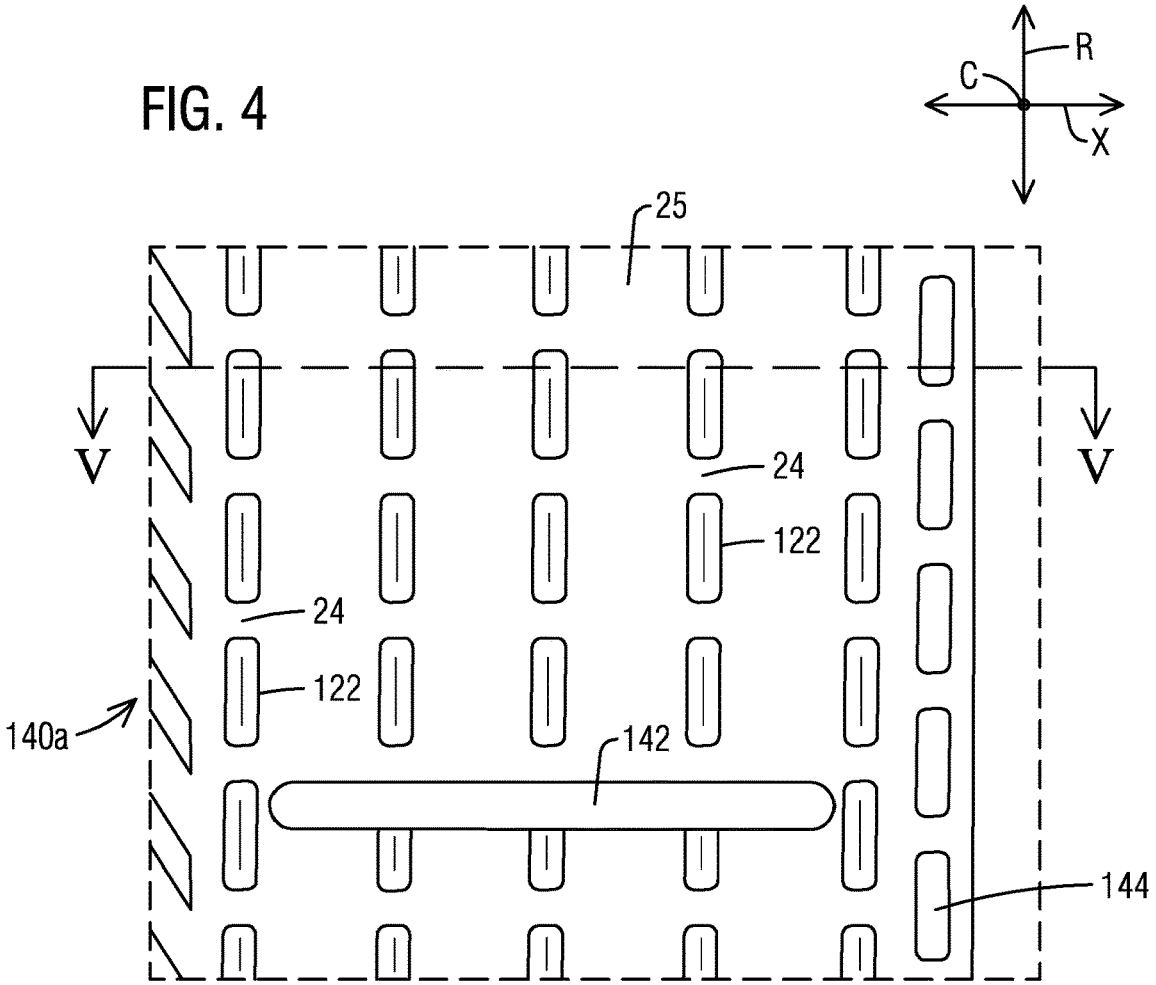
FIG. 4 is an enlarged mid-span core pressure side view showing the trailing edge portion of the casting core.

The present embodiment, as particularly illustrated in FIGS. 2 and 6, provides an improved arrangement of trailing edge cooling features. In this case, the impingement plates are replaced by an array of cooling features embodied as discrete fins 22 in the trailing edge 20. Each discrete fin 22 extending out to, but not all the way through to the other side of the interior 11 of the airfoil 10. The discrete fins 22 can be found extending from the surface of both the pressure sidewall 14 and the suction sidewall 16 towards the opposite sidewall within the interior 11. The discrete fins 22 on the pressure side 14 are offset from the discrete fins 22 on the suction side 16 along the axial direction. The discrete fins 22 can be arranged in an in-lined or staggered array along the radial and axial directions. The features 22 are arranged in radial rows as shown in FIGS. 2 and 6. The features 22 in each row are interspaced to define axial coolant passages 24. The rows are spaced along the chordal axis 30 to define radial coolant passages 25. FIG. 4 shows where the axial coolant passages 24 and the radial coolant passages 25 are positioned once a casting process is completed.

The features 22 in adjacent rows may be staggered in the radial direction. The axial coolant passages 24 of the array are fluidically interconnected via the radial coolant passages 25, to lead a pressurized coolant Cf in the trailing edge coolant cavity 40*f* toward the coolant exit slots 28 at the trailing edge 20 via zigzagging flow passages as shown in FIG. 6. In particular, the pressurized coolant Cf flowing generally forward-to-aft impinges on to the rows of features 22, leading to a transfer of heat to the coolant Cf accompanied by a drop in pressure of the coolant Cf. Heat may be transferred from the outer wall 12 to the coolant Cf by way of convection and/or impingement cooling, usually a combination of both.

In the illustrated embodiment, each feature 22 is elongated along the radial direction. That is to say, each feature 22 has a length in the radial direction which is greater than a width in the chord-wise direction. A higher aspect ratio provides a longer flow path for the coolant Cf in the radial coolant passages 25, leading to increased cooling surface area and thereby higher convective heat transfer. In relation to the double or triple impingement plates, the described arrangement provides a longer flow path for the coolant Cf and has been shown to increase both heat transfer and pressure drop to restrict the coolant flow rate. Such an arrangement may thus be suitable in advanced turbine blade applications which require smaller amounts of cooling air.

The exemplary turbine airfoil 10 may be manufactured by a casting process involving a casting core 140, typically made of a ceramic material. The core material represents the hollow coolant flow passages inside the turbine airfoil 10. It is beneficial for the casting core to have sufficient structural strength to survive through the handling during the casting process. To this end, the production of the discrete fins 22 does not create structural interruption and maintain the core strength while restricting the flow through the blade trailing edge cooling passages. Embodiments of the present invention provide an improvement to achieve not only a strong casting core but also a limitation in the coolant flow.

Figure 3:
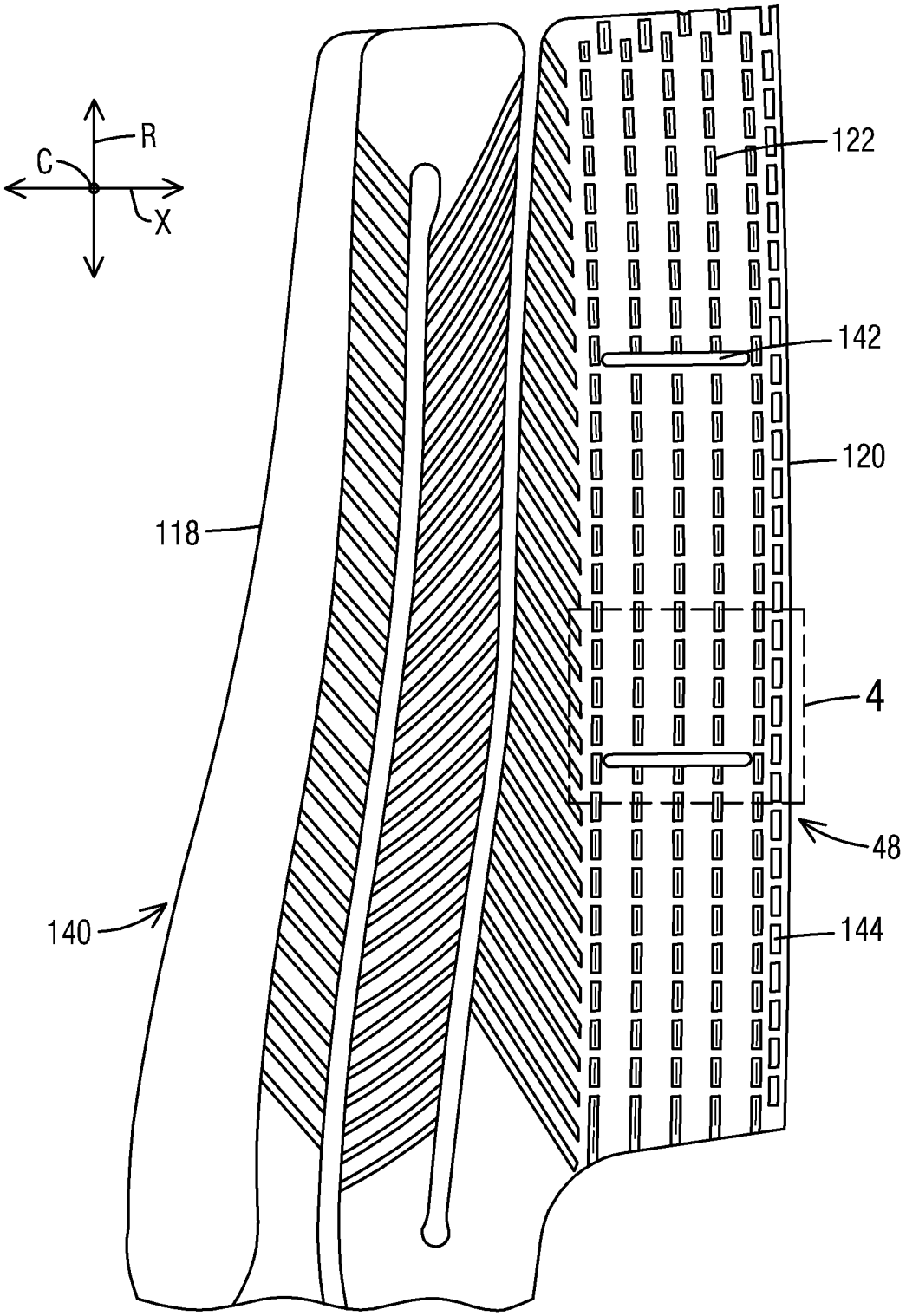
FIG. 3 is a partial core pressure side view of a casting core according to an exemplary embodiment of the invention.
Figure 5:
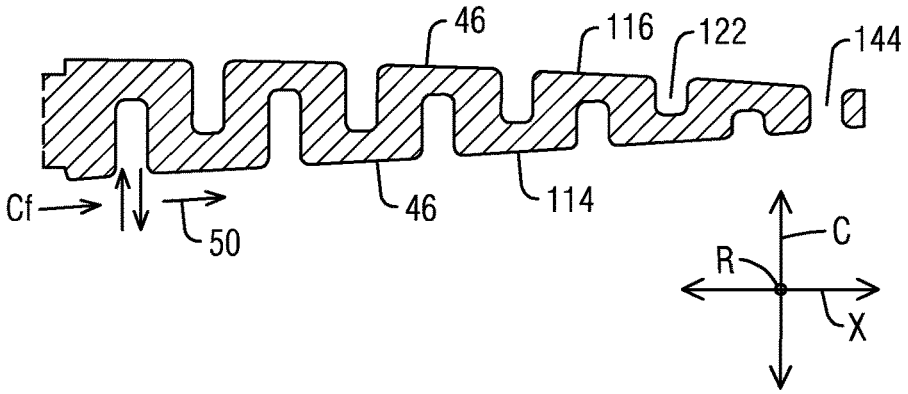
FIG. 5 is a cross-sectional view along the section V-V of FIG. 4.

FIGS. 3 through 5 illustrate an exemplary casting core 140 for manufacturing the inventive turbine airfoil 10. A trailing edge portion of the casting core 140 is a core element 140*a* partially shown in FIGS. 4 and 5 represents a section of the trailing edge portion of the turbine airfoil 10. The core element 140*a* has a core pressure side 114 and a core suction side 116 extending in the span-wise direction, and extending chord-wise from a core leading edge 118 toward a core trailing edge 120. FIGS. 3 and 4 are core pressure side 114 views with FIG. 4 focusing on the trailing edge 120 features. As shown, the core element 140*a* includes a plurality of discrete non-perforated indentations 122 on the surface of the core pressure side 114 and the core suction side 116.

The discrete non-perforated indentations 122 on the core pressure side 114 are offset from the discrete non-perforated indentations 122 on the core suction side 116 along the axial direction. The discrete non-perforated indentations 122 can be arranged in an in-lined or staggered array along the radial and axial directions.

In the embodiments shown, the discrete non-perforated indentations 122 are in a rectangular or racetrack shape. Further, the discrete non-perforated indentations 122 provide a more uniform distribution than a conventional design. An increase in cooling along the exterior wall and more effective designs of advanced blades may be achieved through embodiments described herein. Manufacturing of the discrete non-perforated indentations 122 as the majority if not the entirety of an internal arrangement 48 is an easier and more efficient process than pin perforations alone or pin perforations as a majority of the internal arrangement 48.

The discrete non-perforated indentations 122 along the core trailing edge 120 create a zigzag flow passages seen in FIG. 5 once a casting is complete. The zigzag flow passages bring higher speed coolant flow adjacent to an external hot outer wall 12 for a more uniform cooling.

As shown in FIGS. 3 through 5, in certain embodiments at least one row of radially running through-hole perforations 144 may be located between the array of discrete non-perforated indentations 122 and the trailing edge 120 extending all the way up to the span-wise ends thereof. The radially running through-hole perforations 144 in the casting core 140 provide discrete radially running pins 44 that connect the pressure sidewall 14 and the suction sidewall 16 in the casted inventive turbine airfoil 10. Further, in certain embodiments, at least one axially running through-hole perforation 142 may be added in between the discrete non-perforated indentations 122 of the casting core 140. The at least one axially running through-hole perforation 142 in the casting core 140 provides at least one discrete axially running pin 42 that acts like an axial shelf. The at least one axially running pin 42 also connects the pressure sidewall 14 and the suction sidewall 16 of the turbine airfoil 10. The at least one radially running pin 44 and the at least one axially running pin 42 may provide structural support between the pressure sidewall 14 and the suction sidewall 16. The at least one axially running pin 42 may also divide the cooling of the trailing edge 20 into multiple radial cooling zones to tailor for the local heat transfer needs. FIG. 3 and FIG. 4 show these aspects of the embodiments in further detail. The size and spacing and number of the discrete non-perforated indentations 122 can be varied and tailored for each different radial cooling zone.

With the discrete non-perforated indentations, a ceramic core will not require additional cleaning after a core die is removed during the manufacturing process. This can be a significant savings in manufacturing costs. As mentioned above, the discrete non-perforated indentations do not interrupt the structure and therefore the core can maintain its strength while still restricting flow through the blade trailing edge cooling passages.

The at least one axially running through-hole perforation 142 once casted each become an axial partition shelf that can provide additional structural support between the pressure sidewall 14 and the suction sidewall 16 of the airfoil 10 and divide the trailing edge cooling into multiple radial cooling zones. These multiple radial cooling zones can be tailored for localized heat transfer needs.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof

The invention claimed is:

1. A turbine airfoil comprising:

an outer wall delimiting an airfoil interior, the outer wall extending span-wise along a radial direction of a turbine engine and being formed of a pressure sidewall and a suction sidewall joined at a leading edge and at a trailing edge;

a trailing edge coolant cavity located in the airfoil interior between the pressure sidewall and the suction sidewall, the trailing edge coolant cavity being positioned adjacent to and extending out to the trailing edge and in fluid communication with a plurality of coolant exit slots positioned along the trailing edge; and an internal arrangement comprising an array of discrete fins located aft of the trailing edge coolant cavity and along of the trailing edge, the array of discrete fins configured to extend out into the interior of the airfoil without reaching the opposite interior sidewall, the discrete fins extending out into the interior of the turbine airfoil alternating from the pressure sidewall and the suction sidewall, the discrete fins form a zigzagging cooling flow passage axially along a chord-wise direction for a cooling fluid between the pressure sidewall and the suction sidewall, wherein the internal arrangement further comprises a row of discrete radially running pins that connect the pressure sidewall and the suction sidewall, and wherein the internal arrangement further comprises at least one axially running shelf along the trailing edge of the turbine airfoil, wherein the at least one axially running shelf provides structural support between the pressure sidewall and the suction sidewall.

2. The turbine airfoil according to claim 1, wherein each discrete fin is elongated in the radial direction.

3. The turbine airfoil according to claim 1, wherein the row of discrete radially running pins is the last row of features along the trailing edge.

4. The turbine airfoil according to claim 1, wherein the row of discrete radially running pins is axially positioned between the array of discrete fins and the trailing edge.

5. A casting core for forming a turbine airfoil, comprising:

a casting core element forming a trailing edge coolant cavity of the turbine airfoil, the core element comprising a core pressure side and a core suction side extending in a span-wise direction, and further extending chord-wise from a core leading edge toward a core trailing edge;

an array of discrete non-perforated indentations are provided on the surface of the core pressure side and the surface of the core suction side along the core trailing edge, the discrete non-perforated indentations forming discrete fins along the interior of the turbine airfoil trailing edge portion aft of the trailing edge coolant cavity along the trailing edge of the turbine airfoil, with the discrete non-perforated indentations being interspaced radially by interstitial core elements that form axial coolant passages in the turbine airfoil and interspaced axially by interstitial core elements that form radial coolant passages in the turbine airfoil, and a row of discrete radially running through hole perforations through the core element located between span-wise ends of the core element, the row of discrete radially running through hole perforations forming a portion of an internal arrangement in the trailing edge interior portion of the turbine airfoil, each radially running through hole perforation extending from the core pressure side to the core suction side and having a length in the radial direction which is greater than a width in the axial direction.

6. The casting core according to claim 5, wherein each discrete non-perforated indentation is elongated in the radial direction.

7. The casting core according to claim 5, wherein the discrete non-perforated indentations on the core pressure side and the core suction side are spaced in a chord-wise direction and span-wise direction.

8. The casting core according to claim 5, wherein the discrete non-perforated indentations on the core pressure side and the discrete non-perforated indentations on the core suction side are alternately positioned in the chord-wise direction forming a zigzagging cross-section in the casting core and zigzagging flow passages in the turbine airfoil casting.

9. The casting core according to claim 5, wherein the row of discrete radially running through hole perforations is the last row of features along the core trailing edge.

10. The casting core according to claim 5, further comprising at least one axially running through-hole perforation through the core element located between span-wise ends of the core element, the at least one axially running through hole perforation forming a portion of an internal arrangement aft of the trailing edge coolant cavity and along the trailing edge of the turbine airfoil, each axially running through hole perforation extending from the core pressure side to the core suction side, with each axially running through hole perforation dividing the core trailing edge into multiple radial cooling zones forming at least one axially running shelf in the turbine airfoil casting providing structural support between the pressure sidewall and the suction sidewall in the turbine airfoil.

11. The casting core according to claim 5, wherein the row of discrete radially running through hole perforations is axially positioned between the array of discrete non-perforated indentations and the trailing edge.

* * * * *